United States Patent [19]

Sluyterman

[11] Patent Number: 4,874,983

[45] Date of Patent: Oct. 17, 1989

[54] PICTURE DISPLAY SYSTEM INCLUDING A DEFLECTION UNIT WITH A DOUBLE SADDLE COIL SYSTEM

[75] Inventor: Albertus A. S. Sluyterman, Eindhoven, Netherlands

[73] Assignee: U.S. Philips Corporation, New York, N.Y.

[21] Appl. No.: 196,652

[22] Filed: May 19, 1988

[30] Foreign Application Priority Data

May 29, 1987 [NL] Netherlands ..... 8701276

[51] Int. Cl.[4] ..... H01J 29/76; H01F 3/12

[52] U.S. Cl. ..... 313/440; 335/211; 335/212

[58] Field of Search ..... 313/412, 413, 428, 431, 313/433, 440; 335/211, 212, 214

[56] References Cited

U.S. PATENT DOCUMENTS 4,357,556 11/1982 Burke ..... 313/440

*Primary Examiner*—Kenneth Wieder

[57] ABSTRACT

Self-convergent picture display system with a color display tube and an electromagnetic deflection unit including a field deflection coil and a line deflection coil which are both of the saddle type and are wound directly on a support. The deflection unit includes a pair of magnetically permeable portions which are arranged symmetrically with respect to the plane of symmetry of the field deflection coil on either side of the tube axis. The magnetically permeable portion draws magnetic flux from the end of the yoke ring in order to extend the vertical deflection field. A self-convergent system can be realized with different screen formats by choosing different lengths of the magnetically permeable portions.

11 Claims, 3 Drawing Sheets

PICTURE DISPLAY SYSTEM INCLUDING A DEFLECTION UNIT WITH A DOUBLE SADDLE COIL SYSTEM

BACKGROUND OF THE INVENTION

The invention relates to a picture display system including a colour display tube having a neck accommodating an electron gun assembly for generating three electron beams, and an electromagnetic deflection unit including a field deflection coil of the saddle type having a front and a rear end for deflecting electron beams generated in the display tube in a vertical direction and a line deflection coil of the saddle type likewise having a front and a rear end for deflecting electron beams generated in the display tube in a horizontal direction and yoke ring of ferromagnetic material surrounds the two deflection coils and has front and rear end faces extending transversely to the tube axis, the electron beam traversing the coils in the direction from the rear to the front ends when the deflection unit is arranged on a display tube.

For some time a colour display tube has become the vogue in which three electron beams are used in one plane; the type of such a cathode ray tube is sometimes referred to as "in-line". In this case, for decreasing convergence errors of the electron beams, a deflection unit is used having a line deflection coil generating a horizontal deflection field of the pincushion type and a field deflection coil generating a vertical deflection field of the barrel-shaped type.

Deflection units for in-line colour display tube systems can in principle be made to be entirely self-convergent, that is to say, in a design of the deflection unit which ensures convergence of the three electron beams on the axes, anisotropic y-astigmatism errors, if any, can simultaneously be made zero in the corners without this requiring extra correction means. While it would be interesting from a point of view of manufacture to have a deflection unit which is selfconvergent for a family of display tubes of the same deflection angle and neck diameter, but different screen formats, the problem exists, however, that a deflection unit of given main dimensions can only be used for display tubes of one screen format. This means that only one screen format can be found for a fixed maximum deflection angle in which aa given deflection unit is self-convergent without a compromise (for example, the use of extra correction means).

The Netherlands Patent Specification 174 198 provides a solution to this problem which is based on the fact that, starting from field and line deflection coils having given main dimensions, selfconvergent deflection units for a family of display tubes having different screen formats can be assembled by modifying the effective lengths of the field and line deflection coils with respect to each other. This solution is based on the recognition that, if selfconvergence on the axes has been reached, the possibly remaining anisotropic y-astigmatism error (particularly the y-convergence error halfway the diagonals) mainly depends on the distance between the line deflection point and the field deflection point and to a much smaller extent on the main dimensions of the deflection coils used. If deflection units for different screen formats are to be produced while using deflection coils having the same main dimensions, the distance between the line and field deflection points may be used as a parameter to achieve self-convergence for a family of display tubes having different screen formats but the same maximum deflection angle.

The variation in the distance between the line and field deflection points necessary for adaption to different screen formats is achieved in the prior art by either decreasing or increasing the effective coil length of the line deflection coil or of the field deflection coil, or of both - but then in the opposite sense - with the maiin dimensions of the deflection coils remaining the same and with the dimensions of the yoke ring remaining the same, for example, by mechanically making the coil or coils on the rear side smaller and longer, respectively, by a few millimeters, or by positioning, with the coil length remaining the same, the coil window further or less far to the rear (so thata the turns on the rear side are more or less compressed). To achieve this, saddle-shaped line and field deflection coils of the shell type were used. These are coils having ends following the contour of the neck of the tube at least on the gun side. This is in contrast to the conventional saddle coils in which the gun-sided ends, likewise as the screen-sided ends, are flanged and extend transversely to the tube surface. When using saddle coils of the shell type it is possible for the field deflection coil (and hence the vertical deflection field) to extend further to the electron gun assembly than the line deflection coil, if the field design so requires. However, there are also deflection units with deflection coils of the conventional saddle type, which means that - as stated - they have front and rear ends located in planes extending at an angle (generally of 90° ) to the tube axis. (A special type of such a deflection unit with conventional saddle coils is, for example, the deflection unit described in EP 102 658 with field and line deflection coils directly wound on a support). In this case it has until now been impossible to extend the vertical deflection field further to the electron gun assembly than the horizontal deflection field, because the field deflection coil is enclosed between the flanges of the line deflection coil.

SUMMARY OF THE INVENTION

The deflection unit has first and second magnetically permeable portions arranged symmetrically with respect to the plane of symmetry of the field deflection coil on either side of the tube axis, each magnetically permeable portion having a first end located opposite the rear end face of othe yoke ring and a second end located at the neck of the display tube in the proximity of the location where the electron beams leave the electron gun assembly. The length of the first and second magnetically permeable portions and their distance to the yoke ring are dimensioned for providing a self-convergent picture display system.

The invention is based on the recognition that the first ends of the magnetically permeable portions draw a field deflection flux which is taken up is adjusted by means of the distance between the first ends and the yoke ring, and the length of the magnetically permeable portions determines how far the vertical deflection field is extended to the rear.

A practical embodiment of the picture display system according to the invention is characterized in that regions of the rear end of the yoke ring located on either side of the plane of symmetry of the line deflection coil are left free by the rear end of the field deflection coil and in that the first ends of the magnetically permeable portions are located opposite said regions.

The invention can particularly be used to advanatage if the field deflection coil and the line deflection coil are directly wound on a support.

The invention also relates to an electromagnetic deflection unit suitable for use in a picture display system as described hereinbefore.

For use in a display tube having a larger screen format than the display tube for which it is designed, the invention provides the possibility of moving apart the deflection points of the horizontal deflection field and the vertical deflection field generated by a given deflection unit having saddle coils and of moving them towards each other for use in a display tube having a smaller screen format.

The great advantage of the invention is that only a modification of the length of the magnetically permeable portions (providing or omitting them, respectively) is required to adapt a deflection unit to different screen formats of a display tube family.

BRIEF DESCRIPTION OF THE DDRAWING

FIG. 1 is a diagrammatic vertical cross-section through the color display tube,

FIG. 2 is a diagrammatic horizontal cross-section through the colour display tube of FIG. 1, FIG. 3 is a rear view of the yoke ring with field deflection coils of the deflection unit of FIGS. 1 and 2, FIG. 4 is a rear view of the colour display tube of FIG. 1 having a first set of magnetically permeable portions according to the invention, FIG. 5 is a rear view of the colour display tube of FIG. 1 having a second set of magnetically permeable portions according to the invention, FIG. 6 shows the axial variation of the respective deflection fields in a first combination of a display tube and a deflection unit, and FIG. 7 shows the axial variation of the respective deflection fields in a second combination of a display tube and a deflection unit.

DETAILED DESCRIPTION OF THE PREFERRED EMBODIMENT

Figure 1:
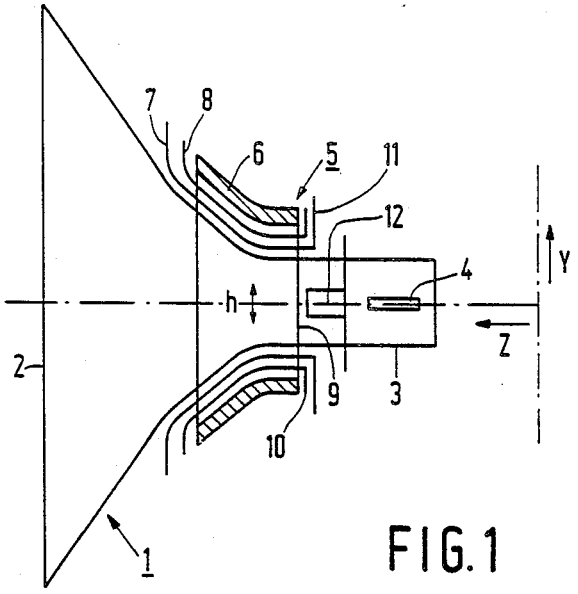

FIG. 1 is a diagrammatic elevational view of a vertical cross-section through a colour display tube 1 of the "in-line" type having a display screen 2, a tube neck 3 and three co-planar electron guns 4. A deflection unit 5 mounted on the display tube comprises a yoke ring 6, a saddle coil 7 for the horizontal deflection (the so-called line deflection coil) and a saddle coil 8 for the vertical deflection (the so-called field deflection coil).

The yoke ring 6 has a gun-sided end 9, the field deflection coil 8 has a (flange-shaped) gun-sided end 10 and the line deflection coil has a (flange-shaped) gun-sided end 11.

Figure 2:
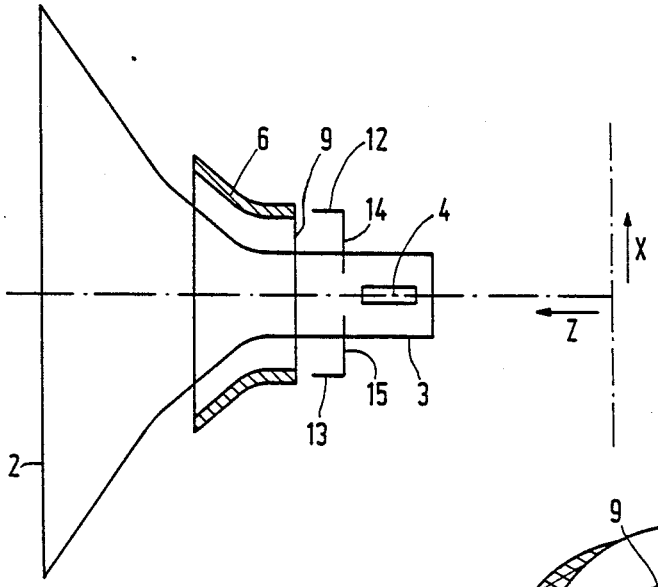

The deflection unit 5 is provided with magnetically permeable portions 12 and 13 (see also FIGS. 2 and 4) which are arranged symmetrically with respect to the plane of symmetry of the field deflection coil 8 (the y-z plane), and which extend up to a small distance from the gun-sided end 9 of the yoke ring 6. The portions 12 and 13 take up magnetic flux from the yoke ring 6 and due to their special positioning and construction they produce an extra (vertical deflection) field. The location of this extra field, as well as its quantity can be adjusted by the shape of the portions 12 and 13. The problem of screen-format adaption (trilemma problem) when using deflection units with a set of double saddle coils can be solved thereby. A type of deflection unit with a double set of saddle coils which is currently in the limelight is particularly tye type in which the two saddle coils are directly wound on a hollow support, either on the same support, or each on a separate support.

Figure 3:
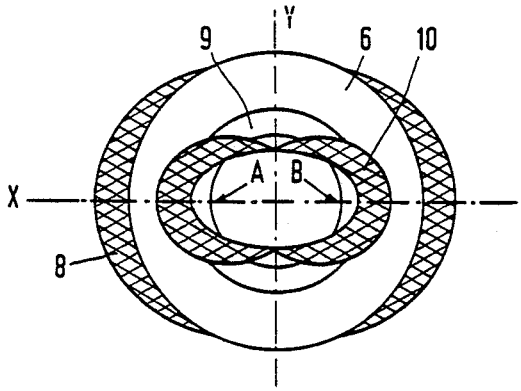

It will be evident that is necessary to form the (flange-shaped) gun-sided end 10 of the field deflection coil 8 in such a manner that regions A and B of the gun-sided end 9 of the yoke ring 6 locate don either side of the plane of symmetry of the line deflection coil 7 (the x-z plane) are accessible. The regions from which the magnetically permeable portions 12 and 13 must withdraw magnetic flux, the regions A and B, are denoted by arrows in FIG. 3. In other words, the insides of the saddle heads of the gun-sided field deflection coil end 10 must be sufficiently high to leave the gun-sided end 9 of the yoke ring 6 locally free. For the sake of clarity the line deflection coil 7 is not shown in FIG. 3. The line deflection coil 7 must of course also enable the regions A and B of the gun-sided end 9 of the yoke ring 6 to be accesed, but in general no special measures need to be taken for this purpose. However, it must be ensured that the saddle heads of the gun-sided line deflection coil end leave open a sufficiently large region on either side of the y-z plane in order to reach the yoke ring 6 with magnetically permeable portions 12 and 13 of some height h (see FIG. 1). Finally it will be evident that also the support (not shown in the Figures) of the field deflection coil 8 must have apertures to provide access to the regions A and B of the yoke ring 6 with the magnetically permeable portions 12 and 13.

The above-descibed measures combined comprise the preparation of a deflection unit for providing magnetically permeable portions extending the vertical deflection field.

As already mentioned hereinbefore, the length of the portions 12 and 13 determines the location of the extra field and the distance between parts 12 and 13 and the yoke ring 6 determines the quantity of the field.

Figure 4:
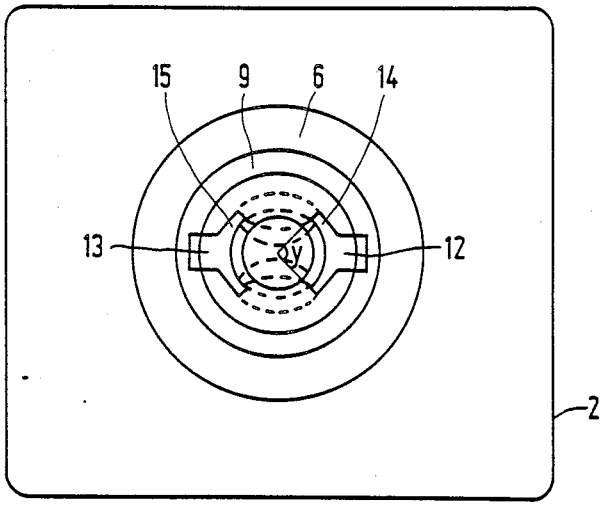

The ends of the portions 12 and 13 remote from the yoke ring 6 preferably have inwardly extending arms. Such inwardly extending arms are denoted by the reference numerals 14 and 15 in FIGS. 2 and 4. The value of the angle $\Phi$ which they embrace (see FIG. 4) determines the sixpole/dipole ratio of the extra field. Possibly remaining convergence errors can be corrected by controlling the sixpole/dipole ratio. In FIG. 4 the embraced angle $\Phi$ is large, which means that the extra field has a positive sixpole component. (Compare the field distribution indicated by the broken lines).

Figure 5:
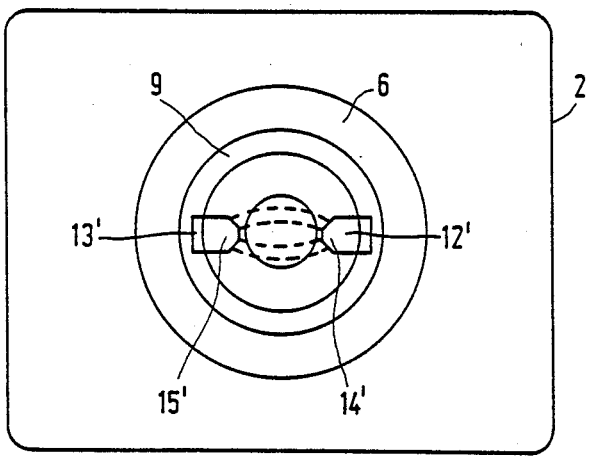

In FIG. 5 the angle embraced by the inwardly extending arms 14' and 15' is very small, which means that the extra field not only has a dipole component but also a negative sixpole component (compare the field distribution indicated by the broken lines). A configuration generating an extra field with substantially only a dipole field lies in between the configurations shown in FIGS. 4 and 5.

Figure 6:
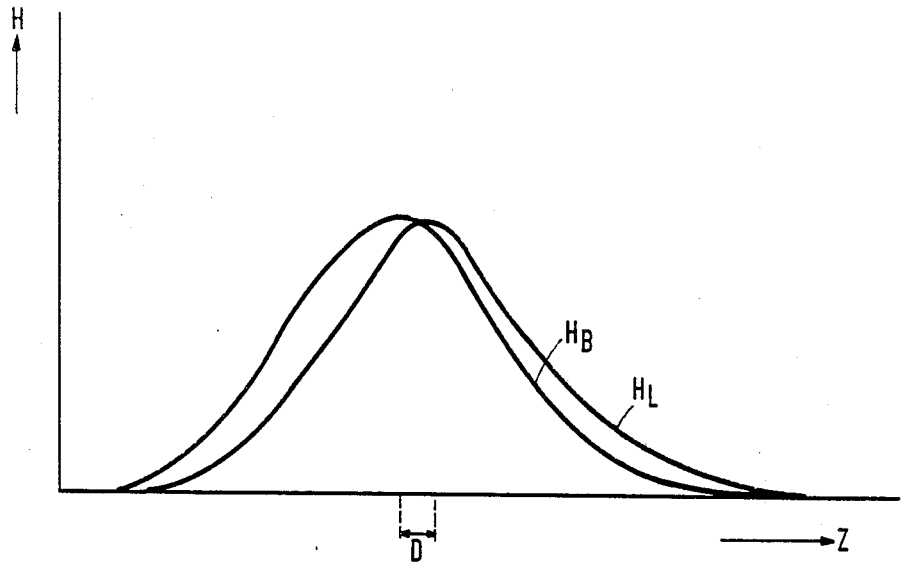

By changing the length of the portions 12 and 13, the distance between the line and field deflection points is changed and hence a deflection unit is obtained which is self-convergent for another screen format. This is explained with reference to FIGS. 6 and 7. A vertical deflection field $H_B$ and a horizontal deflection field $H_L$ are generated by means of a deflection unit of the type shown in Figure 1. The field distribution measured in the direction of the axis of the display tube is as shown in FIG. 6. The Gauss deflection points of the two fields are a distance D apart.

Figure 7:
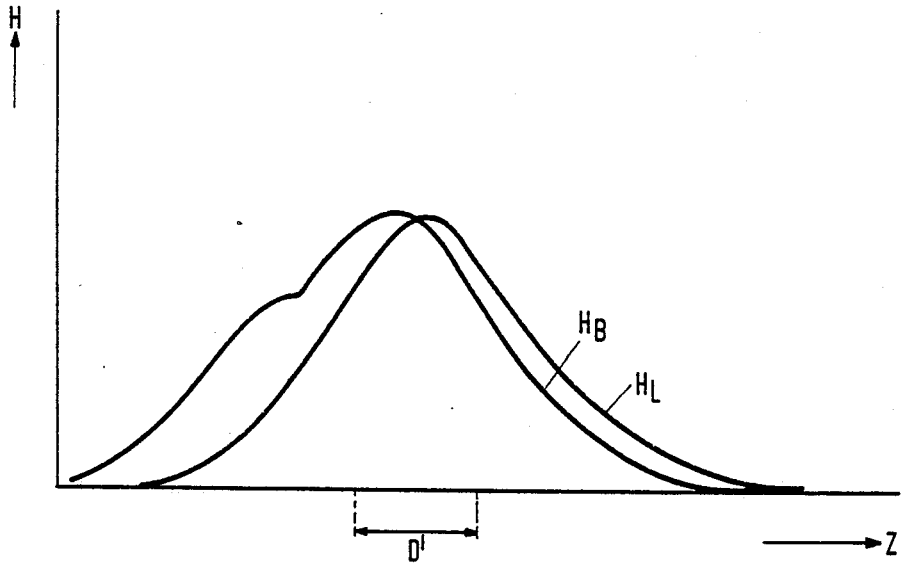

A verical deflection field and a horizontal deflection field having a field distribution a shown in FIG. 7 are generated by means of a deflection unit having longer magnetically permeable portions 12 and 13. In this case the distance between the Gauss deflection points is D' with $D'-D=\Delta D$.

What is claimed is:

1. A picture display system including a color display tube having a neck accommodating an electron gun assembly for generating three electron beams, and an electromagnetic deflection unit surrounding the paths of the electron beams which have left the electron assembly, said deflection unit comprising a field deflection coil of the saddle type having a front and a rear end for deflecting electron beams generated in the display tube in a vertical direction;

a line deflection coil of the saddle type likewise having a front and a rear end for deflecting electron beams generated in the display tube in a horizontal direction, and a yoke ring of ferromagnetic material surrounding the two deflection coils and having front and rear end faces extending transversely to the tube axis, the electron beam traversing the coils in the direction from the rear to the front ends when the deflection unit is arranged on a display tube, characterized in that the deflection unit also has first and second magnetically permeable portions arranged symmetrically with respect to the plane of symmetry of the field deflection coil on either side of the tube axis, each magnetically permeable portion having a first end located opposite the rear end face of the yoke ring and a second end located at the neck of the display tube in the proximity of the location where the electron beams leave the electron gun assembly, the length of the first and second magnetically permeable portions and their distance to the yoke ring being dimensioned for providing a self-convergent picture display system.

2. A picture display system as claimed in claim 1 characterized in that regions of the rear end of the yoke ring located on either side of the plane of symmetry of the line deflection coil are left free by the rear end of the field deflection coil and in that the first ends of the magnetically permeable portions are located opposite said regions.

3. A picture display system as claimed in claim 1 characterized in that the field deflection coil and the line deflection coil are directly wound on a support.

4. Apparatus for adapting a self-convergent deflection unit of the type mountable on the neck of a display tube and including a saddle type field deflection coil screen end and a gun end extending away from said tube in a plane disposed at an angle to a tube axis, and a yoke ring having a screen end and a gun end, for use with display tubes having different screen formats comprising:

format adjustment means disposed adjacent to the gun end of the yoke ring for coupling flux from the yoke ring to the neck of the tube to supplement the field produced by the vertical deflection coil to uniformly increase the vertical deflection field to produce a raster having a different format from the raster produced by said deflection unit alone.

5. The apparatus of claim 4 wherein said field deflection coil is arranged symmetrically about a plane of symmetry passing through said neck and said format adjustment means comprises first and second magnetically permeable members arranged symmetrically about said plane of symmetry, each of said magnetically permeable members having a first end disposed adjacent the gun end of the yoke ring and a second end disposed adjacent the neck of the display tube.

6. The apparatus of claim 5 wherein each of said first and second magnetically permeable members comprises a first end located opposite a gun end face of the yoke ring, and a second end located at the neck of the display tube adjacent the location where the electron beams leave the electron gun assembly.

7. The apparatus of claim 6 wherein said first end comprises a portion of said permeable member disposed parallel to the neck of the displaya tube and said second end comprises a portion of said magnetically permeable member located perpendicular to the neck of the display tube.

8. The apparatus of claim 7 wherein said second endsn of said magnetically permeable members have inwardly extending arms subtending a first angle.

9. The apparatus of claim 8 wherein said angle is large so that the supplemental field has a positive sixpole component.

10. The apparatus of claim 8 wherein said angle is very small, so that said supplemental field has a dipole component and a negative sixpole component.

11. Apparatus for adapting a self-convergent deflection unit of the type used on the neck of a display tube having an electron gun disposed in a neck of said tube, said deflection unit including a field deflection coil of the saddle type having a rear end portion disposed at an angle to the axis of said tube, comprising means disposed adjacent to said neck between said electron gun and said deflection unit, and coupled to said deflection unit for changing the distance between the line and field deflection points for causing said deflection unit to produce a different screen format.

* * * * *